US011624573B1

(12) United States Patent
Blazek et al.

(10) Patent No.: US 11,624,573 B1
(45) Date of Patent: Apr. 11, 2023

(54) MAGAZINE RELEASE WITH SPRING CHANNEL

(71) Applicant: New DeSignz Inc., Cheshire, CT (US)

(72) Inventors: Antonin Blazek, Southington, CT (US); David F. Dziob, Meriden, CT (US)

(73) Assignee: New DeSignz, Inc., Cheshire, CT (US)

( * ) Notice: Subject to any disclaimer, the term of this patent is extended or adjusted under 35 U.S.C. 154(b) by 0 days.

(21) Appl. No.: 17/496,390

(22) Filed: Oct. 7, 2021

(51) Int. Cl.
*F41A 17/38* (2006.01)
*F41A 9/59* (2006.01)

(52) U.S. Cl.
CPC ..... *F41A 9/59* (2013.01); *F41A 17/38* (2013.01)

(58) Field of Classification Search
CPC ..... F41A 17/38
See application file for complete search history.

(56) References Cited

U.S. PATENT DOCUMENTS 4,236,337 A * 12/1980 Beretta ..... F41A 35/06 42/7
4,573,280 A * 3/1986 Malhotra ..... F41A 17/38 42/7
4,638,581 A * 1/1987 Moore ..... F41A 17/38 42/7
4,835,892 A * 6/1989 Ruger ..... F41A 35/06 42/7
5,058,301 A * 10/1991 Lishness ..... F41A 17/38 42/7
6,141,895 A * 11/2000 Rost ..... F41A 35/06 42/6
8,166,691 B1 * 5/2012 Karfiol ..... F41A 17/38 42/6
9,964,372 B1 * 5/2018 O'Clair ..... F41A 35/06
10,365,058 B1 * 7/2019 Miller ..... F41A 17/38
2007/0169390 A1 * 7/2007 Bubits ..... F41A 17/38 42/49.01
2017/0199000 A1 * 7/2017 Paquette ..... F41A 17/38

FOREIGN PATENT DOCUMENTS

WO WO-2005124263 A1 * 12/2005 ..... F41A 17/38

OTHER PUBLICATIONS

Zev Extended Magazine Release. <https://web.archive.org/web/20180130140604/https://www.midwestgunworks.com/page/mgwi/prod/MR-4G>. Jan. 30, 2018. (Year: 2018).*

* cited by examiner

*Primary Examiner* — Gabriel J. Klein
(74) *Attorney, Agent, or Firm* — Alix, Yale & Ristas, LLP

(57) ABSTRACT

Disclosed herein is a magazine release. The magazine release includes a spring retainer slot and a spring channel. The spring retainer slot is spaced between a first end and a second end of the magazine release. The spring channel is at a bottom side of the magazine release. The spring channel is adjacent the spring retainer slot. The spring channel is spaced from a top side of the magazine release. The spring channel extends between a front side and a back side of the magazine release. The spring retainer slot includes a first depth from the bottom side. The spring channel includes a second depth from the bottom side. The first depth is substantially equal to the second depth.

18 Claims, 7 Drawing Sheets

MAGAZINE RELEASE WITH SPRING CHANNEL

BACKGROUND

The disclosed embodiments relate to a magazine release for a handgun, and in particular to a magazine release having a spring channel.

Handguns may be disassembled for cleaning, changing configurations, and/or for providing modifications to various components. Many handguns, such as semi-automatic handguns include a magazine and a magazine release. The magazine release is one component that can provide difficulty during disassembly. The magazine release is held in a biased position with a spring. Due to the spring forces acting on the magazine release, this component can be somewhat difficult to remove and/or reinstall/replace.

Accordingly, there is a need to provide an enhanced magazine release having improved ease of installation while maintaining robust and reliable product configurations.

SUMMARY OF THE INVENTION

In accordance with one aspect of the invention, a magazine release is disclosed. The magazine release includes a spring retainer slot and a spring channel. The spring retainer slot is spaced between a first end and a second end of the magazine release. The spring channel is at a bottom side of the magazine release. The spring channel is adjacent the spring retainer slot. The spring channel is spaced from a top side of the magazine release. The spring channel extends between a front side and a back side of the magazine release. The spring retainer slot includes a first depth from the bottom side. The spring channel includes a second depth from the bottom side. The first depth is substantially equal to the second depth.

In accordance with another aspect of the invention, a magazine release is disclosed. The magazine release includes a spring retainer slot and a spring channel. The spring retainer slot is spaced between a first end and a second end of the magazine release. The spring channel is at a bottom side of the magazine release. The spring channel is between the spring retainer slot and the first end of the magazine release. The spring channel is spaced from a top side of the magazine release. The spring retainer slot is open to a back side of the magazine release. The spring channel is open to the back side of the magazine release.

DETAILED DESCRIPTION

Figure 1:
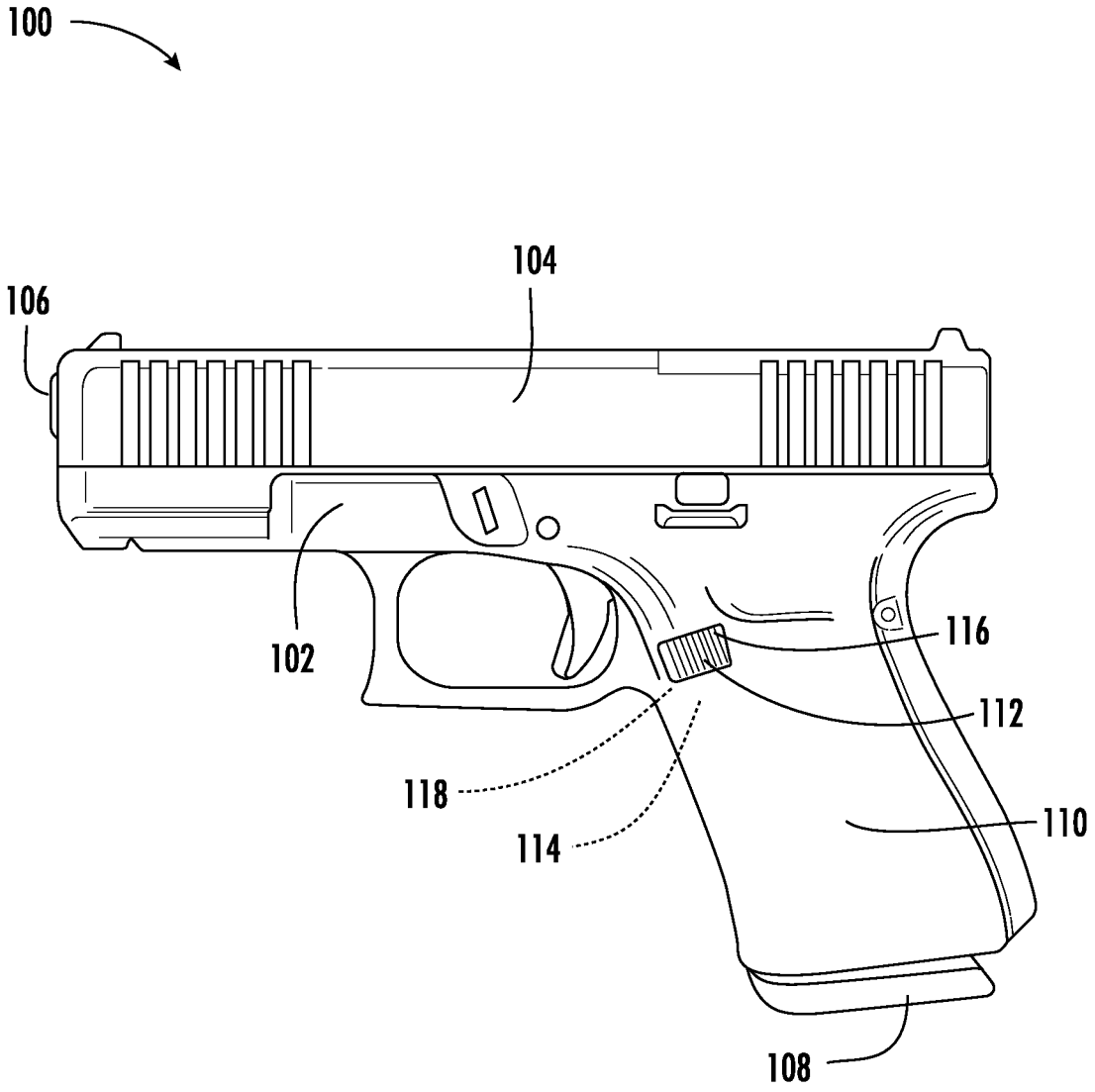
FIG. 1 is a left side view of a pistol having a magazine release incorporating features of the disclosure.
Figure 2:
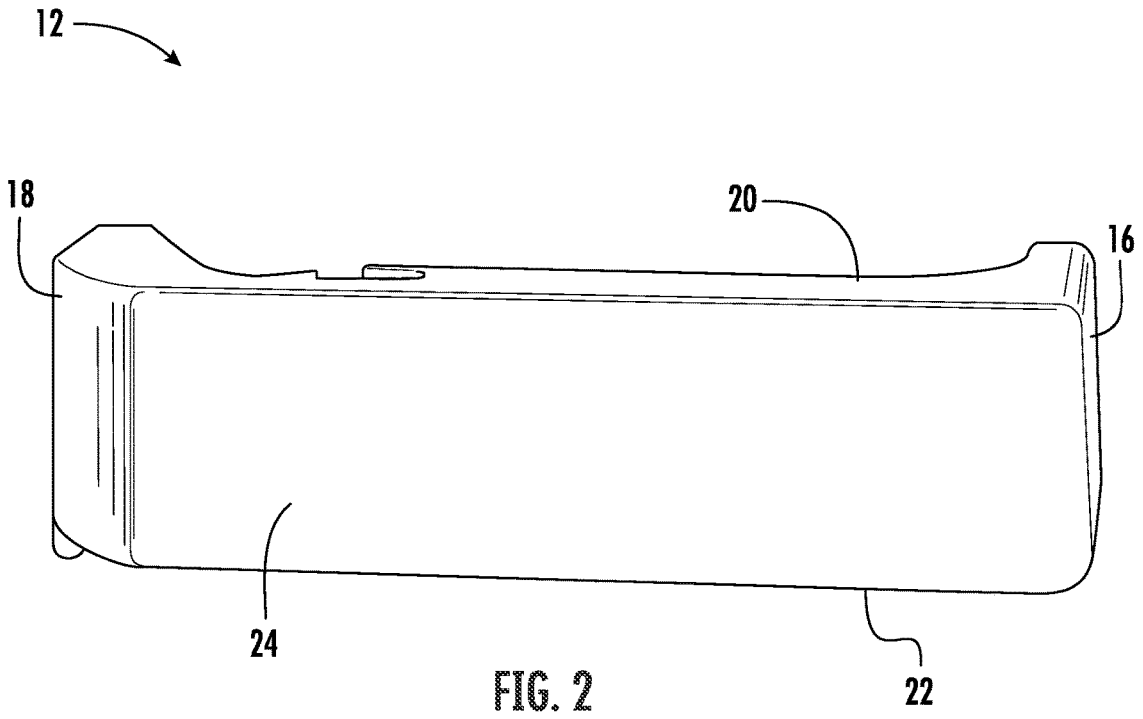
FIG. 2 is a front side view of a conventional magazine release.

With reference to the Figures wherein like numerals identify like elements throughout, a preferred embodiment of a magazine release is disclosed. Referring now to FIG. 1, there is shown a semi-automatic pistol 100 having a frame 102, a slide 104 connected to the frame 102, a barrel 106 inside the slide 104, a magazine 108 removably insertable into a grip portion 110 of the frame, a magazine release 112, and a magazine release spring 114 between the magazine release and an interior of the grip portion of the frame. The magazine release (or magazine catch) 112 is configured to move/slide in a lateral direction relative to the frame (and against a spring bias) so as to release the magazine 108.

The magazine release 112 comprises a first end 116 and second opposite end 118. The first end (or actuation end) 116 comprises a textured surface (such as ridges, knurling, etc.) so as to allow for manipulation by a thumb of a user. For example, the textured surface allows the user to feel the actuation end 116 of the magazine release 112 (for example with the user's thumb, when the user is holding the handgun by the grip portion) so that the magazine 108 can be removed by depressing the actuation end 116 of the magazine release 112.

In this embodiment, the magazine release 112 is reversible and can be installed from either side of the frame 102 for actuation by left-handed or right-handed operation. However in alternate embodiments, the magazine release need not be reversible and may be configured to be installed from only one side of the frame.

Figure 3:
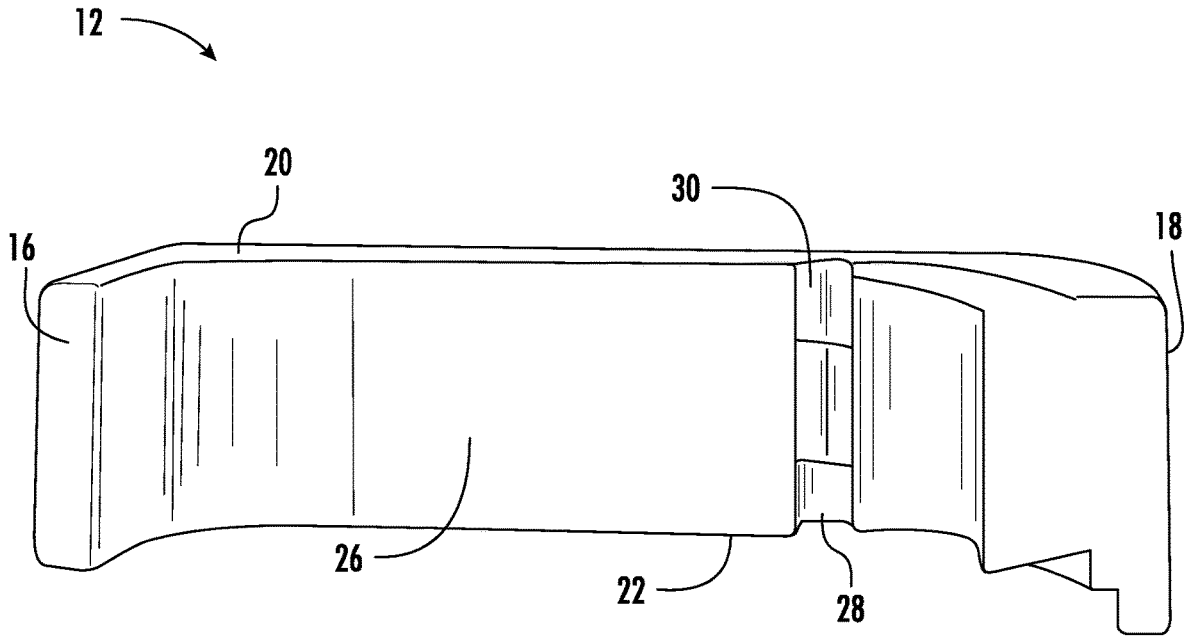
FIG. 3 is a back side view of the conventional magazine release shown in FIG. 2.
Figure 4:
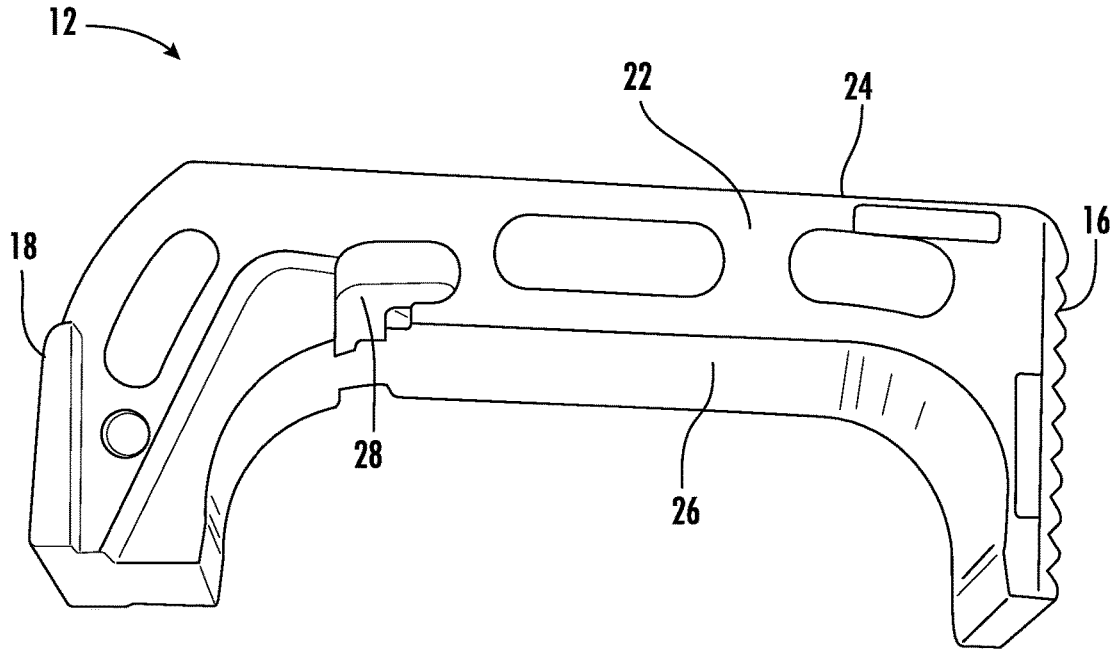
FIG. 4 is a bottom side view of the conventional magazine release shown in FIG. 2.
Figure 5:
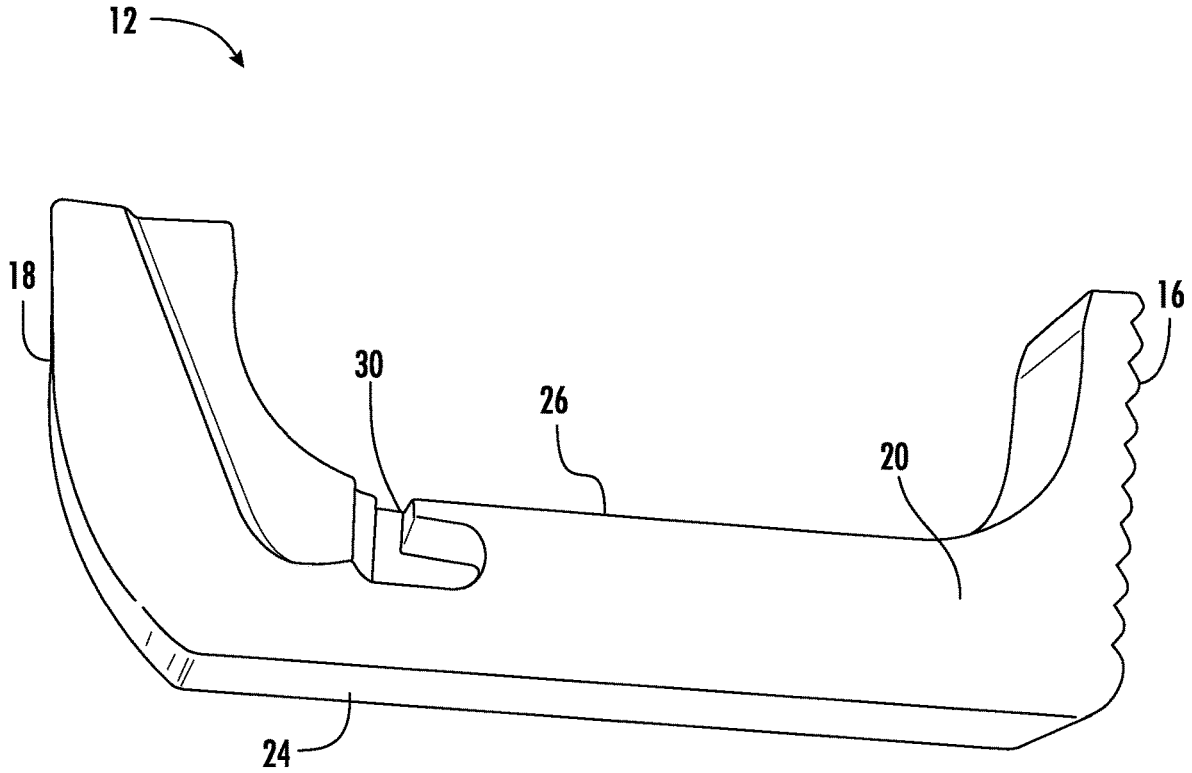
FIG. 5 is a top side view of the conventional magazine release shown in FIG. 2.

The magazine release 112 provides an improved configuration over conventional magazine releases. For example, FIGS. 2-5 show various views of a conventional magazine release 12. The magazine release 12 comprises a general "U" shape and includes a first end 16, a second end 18, a top side 20, a bottom side 22, a front side 24 and a back side 26. The magazine release 12 further comprises spring retainer slots 28, 30 configured to receive an end of the magazine release spring (or magazine catch spring) 114. As shown in FIG. 3, the spring retainer slots 28, 30 are open to the back side 26 of the magazine release 12 with no other relief areas for the end of the spring 114. As such, when the user attempts to remove the magazine release from the frame 102, the spring 114 must be moved against its bias out of the retention slot 28, 30 (and away from the frame) with the spring biased towards the back side 26 of the magazine release 12. This biasing force on the back side 26 of the magazine release 12 (away from the retention slot 28, 30) causes difficulty in removing the conventional magazine release 12 (due to the stiffness of the magazine release spring 114).

According to various exemplary embodiments, the magazine release 112 provides for easier removal and installation of the magazine release and requires less effort by the user. Referring now to FIGS. 6-9, the magazine release 112 includes the first end 116 and the second end 118 (as mentioned above), a top side 120, a bottom side 122, a front side 124, a back side 126, and spring retainer slots 128, 130, similar to the magazine release 12, however the magazine release 112 further includes a relief area at the bottom side 122 of the magazine release at spring channel 132, and a relief area at the top side of the magazine release at spring channel 134.

Figure 7:
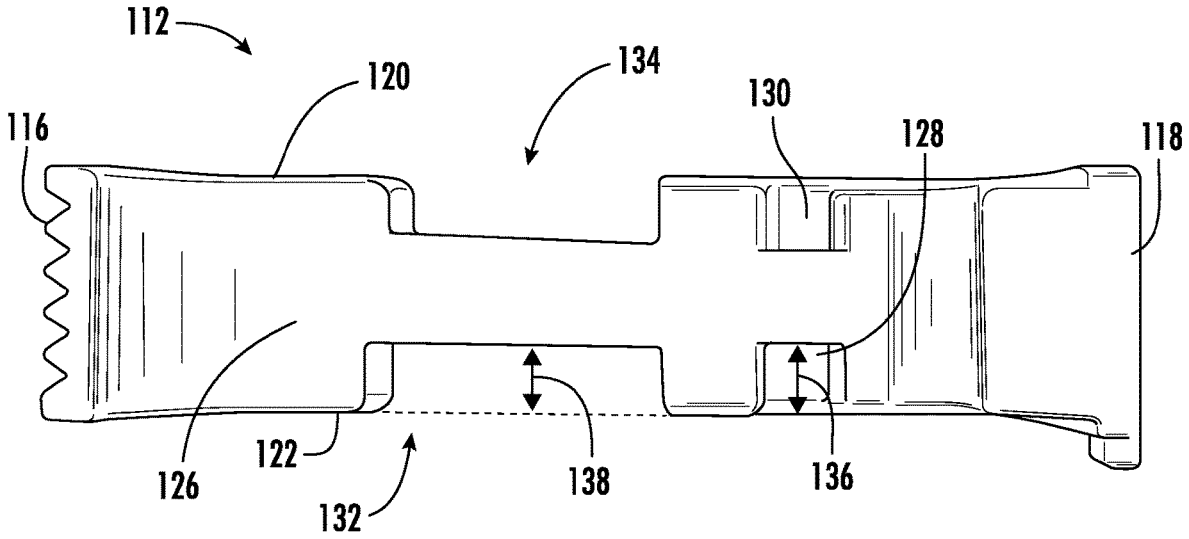
FIG. 7 is a back side view of the magazine release shown in FIG. 6.
Figure 8:
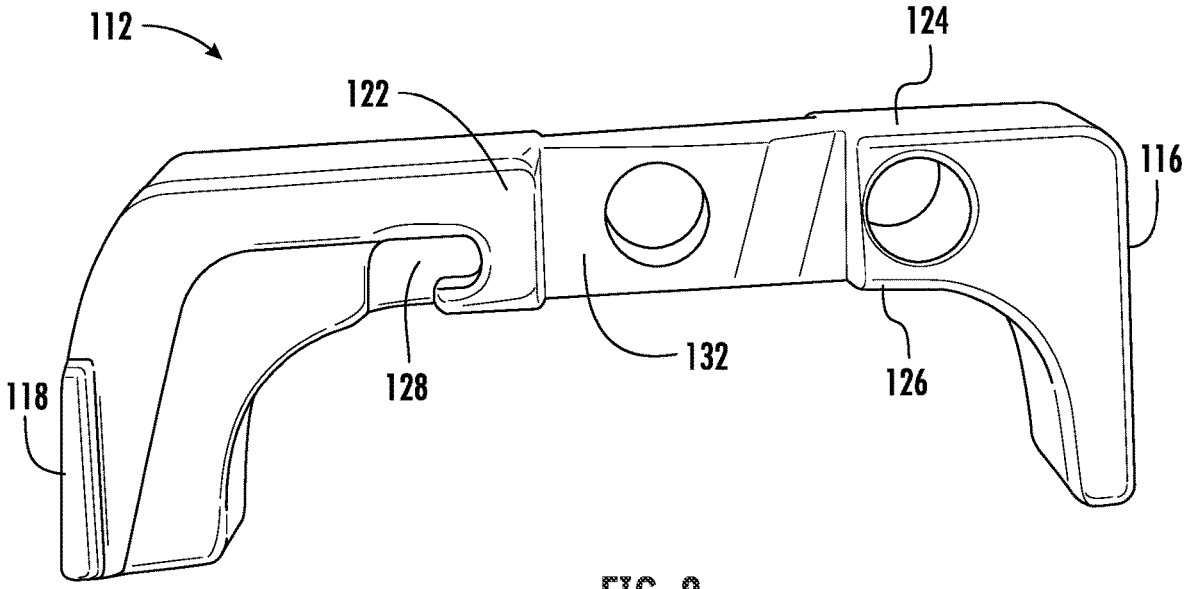
FIG. 8 is a bottom side view of the magazine release shown in FIG. 6.
Figure 9:
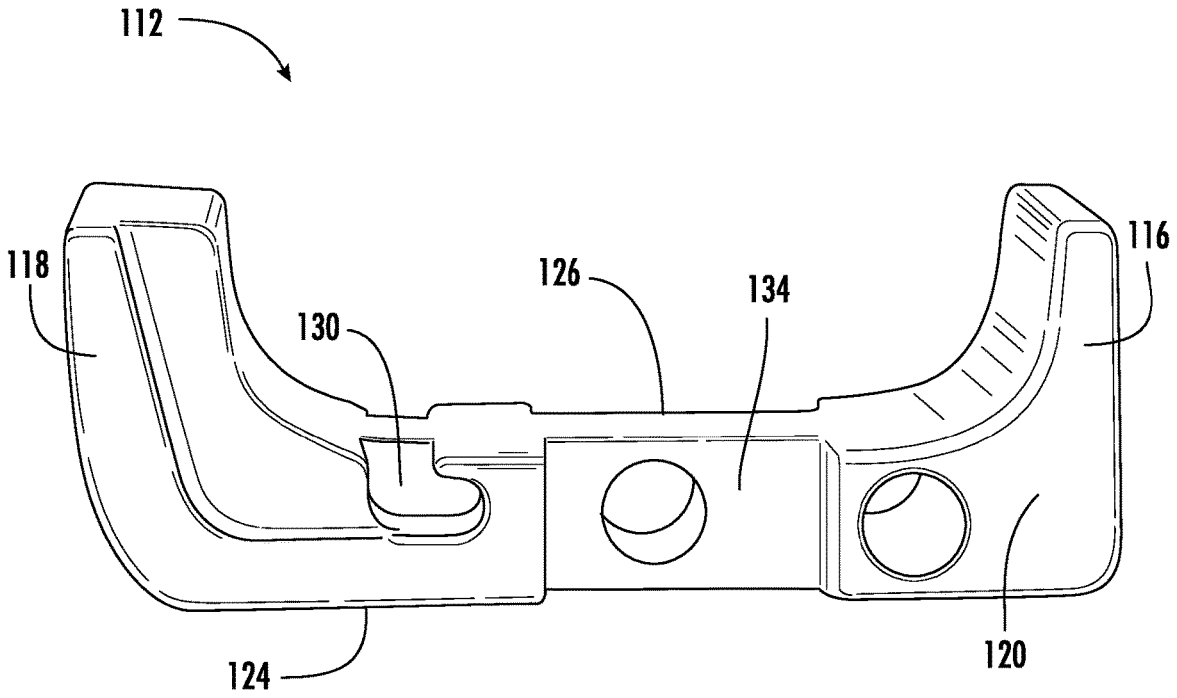
FIG. 9 is a top side view of the magazine release shown in FIG. 6.
Figure 10:
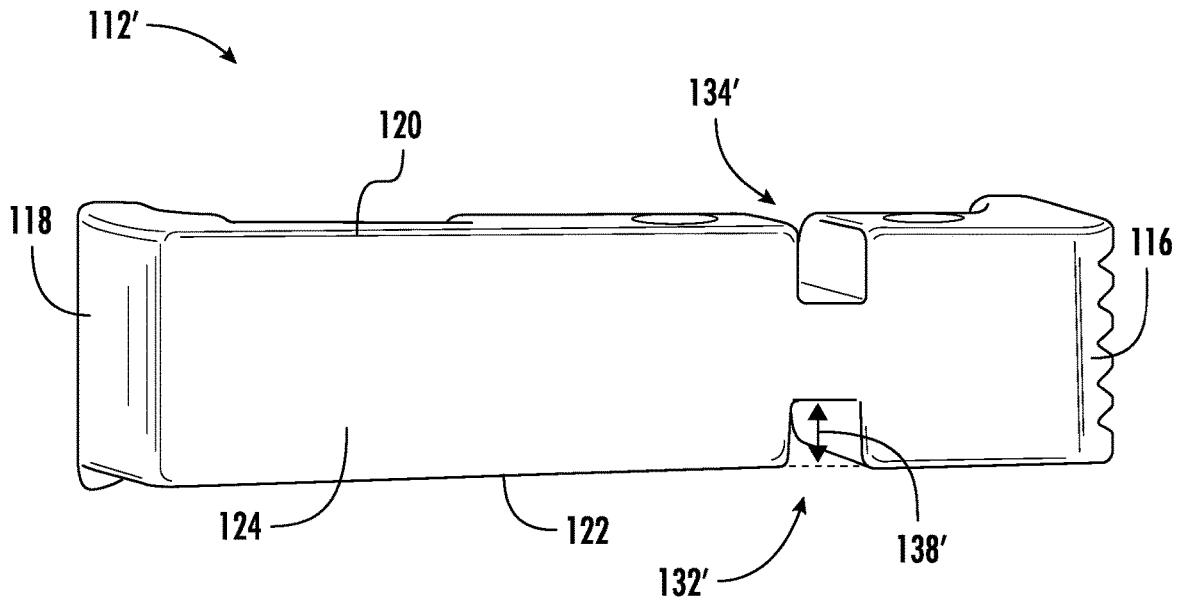
FIG. 10 is a front side view of another embodiment of the magazine release shown in FIG. 1 incorporating features of the disclosure.
Figure 11:
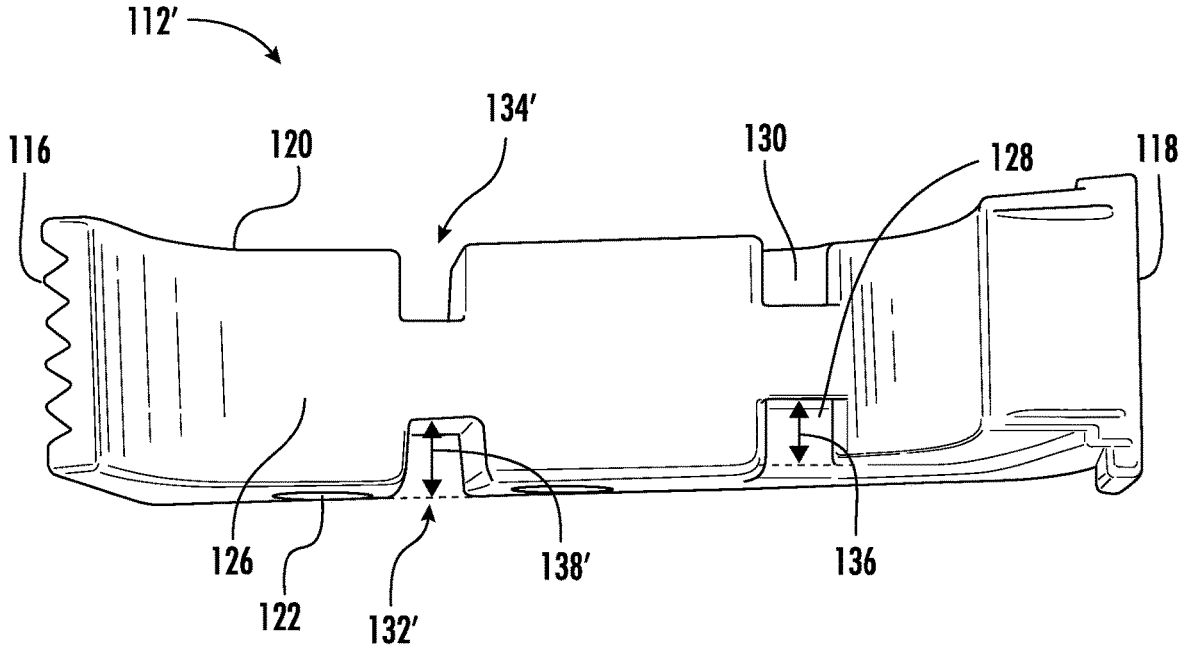
FIG. 11 is a back side view of the magazine release shown in FIG. 10.
Figure 12:
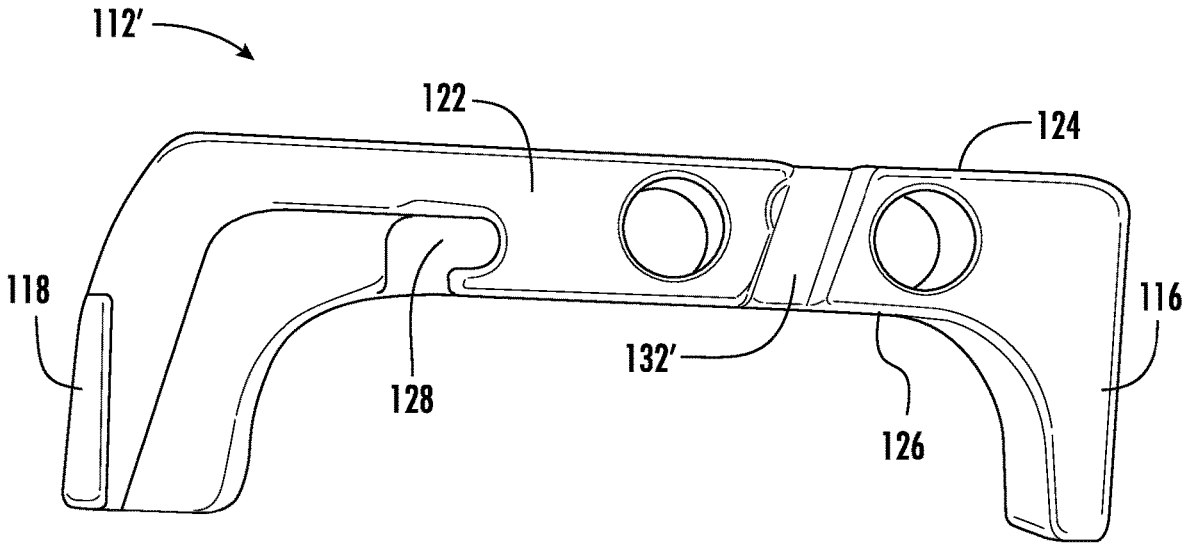
FIG. 12 is a bottom side view of the magazine release shown in FIG. 10.
Figure 13:
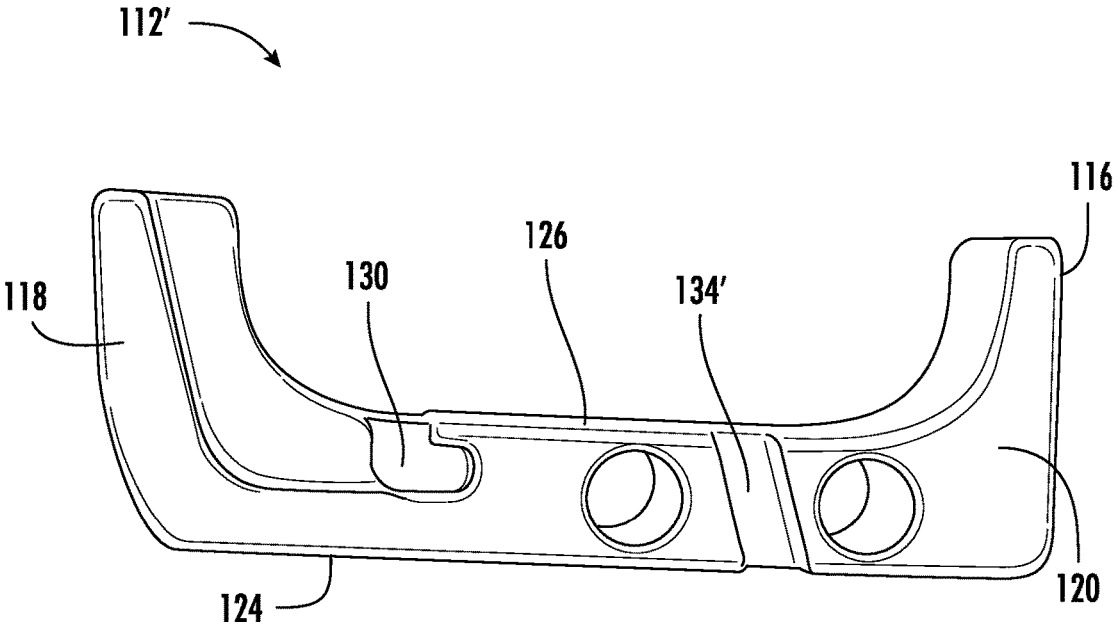
FIG. 13 is a top side view of the magazine release shown in FIG. 10.

The magazine release 112 comprises an integrally formed one-piece member having a general "U" shape. According to various exemplary embodiments, the magazine release 112 may be fabricated from metal, plastic, or any other substantially rigid material. As mentioned above, the first end (or actuation end) 116 comprises a textured surface and the opposite second end 118 comprises a flared end. As best seen in FIG. 7, a dimension between the top and bottom sides 120, 122 is greater at the flared end 118 than at the actuation end 116. The flared end 118 (having the greater dimension) provides a stop feature that does not allow the magazine release 112 to move into the frame 102.

The spring retainer slots 128, 130 are between the curved ends 116, 118 of the magazine release and are off center toward the flared end 118. The retention spring (or magazine release spring) 114 comprises a rod of spring material wherein one end is anchored inside the grip portion 110 of the frame 102 and the other "free" end of the spring 114 projects upward and is inserted in the spring retainer slot 128 of the magazine release. With this configuration, the magazine release is biased by the spring 114 toward a position where the actuation end 116 protrudes from the frame 102.

The magazine release 112 is reversible and can be installed from either side of the frame 102 for actuation by left or right handed operation. The orientation shown in FIG. 1 is a right handed operation orientation (wherein the top side 120 of the magazine release 112 is facing the slide 104) with the "free" end of the spring 114 inserted into the spring retainer slot 128 (which is at the bottom side 122 of the magazine release 112). When the magazine release 112 is switched over for left handed operation (such that the bottom side 122 of the magazine release 112 is facing the slide 104) the "free" end of the spring 114 is inserted into the spring retainer slot 130 (which is at the side 120 of the magazine release 112).

Additionally, the magazine release 112 can only be inserted and removed from the frame 102 in a direction away from the actuation end 116 since the flared end 118 comprises a stop feature (having a larger dimension than the actuation end) that prevents movement through the frame 102 toward the actuation end 116. With the spring retainer slot 128, 130 located off-center and closer to the flared end 116, the spring 114 biases the magazine release 112 toward actuation end 116 so that the actuation end 116 projects from the frame 102.

Figure 6:
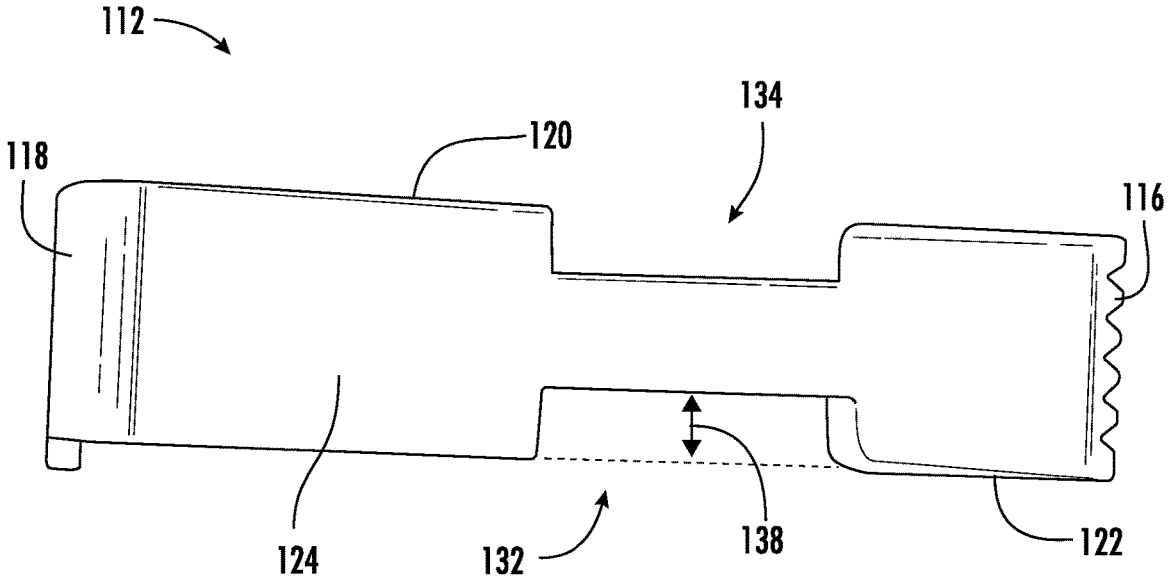
FIG. 6 is a front side view of the magazine release shown in FIG. 1 incorporating features of the disclosure.

The spring channels 132, 134 are located between the spring retainer slots 128, 130 and the actuation end 116 of the magazine release 112. The spring channels are substantially perpendicular to the front side 124 and the flat central portion of the back side 126. According to this embodiment, the channels each comprise a width that extends along a majority of the flat central portion of the back side 126 of the magazine release and each comprise a depth substantially the same as a depth of the spring retainer slots 128, 130. For example, as best seen in FIGS. 6 and 7, the spring retainer slot 128 comprises a depth 136 from the bottom side 122, and the spring channel 132 comprises a depth 138 from the bottom side 122 such that the depth 136 is substantially equal to the depth 138.

The spring retainer slots 128, 130 and the spring channels 132, 134 are open to the back side 126 of the magazine release 112. As such, when the user attempts to remove the magazine release 112 from the frame 102 (when the magazine release 112 is in the right handed orientation of FIG. 1), the spring 114 is moved against its bias out of the retention slot 128 and into the relief area (or spring channel) 132. The spring channel (or groove) 132 allows the "free" end of the spring 114 to go in the groove after it is removed from the retainer slot and this frees the magazine release for removal. Similarly, when the magazine release 112 is installed in the left handed orientation, the spring 114 is moved against its bias out of the retention slot 130 and into the relief area (or spring channel) 134. The spring channel (or groove) 134 allows the "free" end of the spring 114 to go in the groove after it is removed from the retainer slot and this frees the magazine release for removal.

For installation of the magazine release 112, this process is reversed, where the spring is inserted in the groove and urged against its bias to the bottom surface of the magazine release and the release is moved to allow the end of the spring to snap into the retainer slot.

Although the various exemplary embodiments have been described in connection with a wide perpendicular channel between the spring retainer slots and the actuation end, one skilled in the art will appreciate that the various exemplary embodiments are not necessarily so limited and that alternate embodiments may comprise a channel having a different configuration. For example, and referring now also to FIGS. 10-13, there is shown a magazine release 112'. The magazine release 112' is similar to the magazine release 112, however the magazine release 112' comprises a narrow angled groove (or channel) 132', 134' between the spring retainer slots 128, 130 and the actuation end 116.

According to this embodiment, each angled groove 132', 134', is configured to encourage the spring to move toward the surface that will guide the "free" end of the spring into the retainer pocket/slot. Similarly, the depth 138' of each groove 132', 134' is approximately equal to the depth 136 of the slot 128, 130 that retains the spring.

In other alternate embodiments any suitably shaped or oriented channel located at the central (substantially flat) portion of the general "U" shape (i.e. between the curved ends of the general "U" shape) may be provided. It should further be noted that in some embodiments, other depths of the groove (or channel) are envisioned. For example, in some embodiments, the depth of the channel may be greater than the depth of the slot, or in yet other embodiments, any suitable depths may be provided.

While various exemplary embodiments have been described in connection with the magazine release having a spring retainer slot and a spring channel on each of the top and bottom sides of the magazine release, one skilled in the art will appreciate that the various exemplary embodiments are not necessarily so limited and that in alternate embodiments the magazine release may comprise a spring retainer slot and a spring channel on only one of the top and bottom sides of the magazine release.

Technical effects of any one or more of the exemplary embodiments provide an improved magazine release which makes removal and installation of the magazine release easier when compared to conventional configurations. For example, conventional magazine releases generally have a U-shape, but without the spring channel (or groove), the spring must be held against its bias until the curved end of the magazine release is past the spring. According to various exemplary embodiments of the disclosed magazine release, easier removal and installation of the magazine release is provided by including a relief area (for the "free" end of the spring) in the form of a channel or groove between the spring retainer slot and the actuation end.

It should be understood that the foregoing description is only illustrative of the invention. Various alternatives and modifications can be devised by those skilled in the art without departing from the invention. Accordingly, the invention is intended to embrace all such alternatives, modifications and variances.

What is claimed is:

1. A magazine release comprising:

an elongated body having a first actuation end and a second flared retainer end, said body having a top side and an opposed bottom side connected by front and back sides;

a spring retainer slot at the bottom side of the magazine release, spaced between the first actuation end and the flared second retainer end of the magazine release; and a spring channel at the bottom side of the magazine release, wherein the spring channel is adjacent the spring retainer slot, and wherein the spring channel is spaced from the top side of the magazine release;

wherein the spring channel extends between the front side and the back side of the magazine release, wherein the spring retainer slot comprises a first depth from the bottom side, wherein the spring channel comprises a second depth from the bottom side, and wherein the first depth is substantially equal to the second depth;

wherein said spring channel spans the bottom side completely from said back side to said front side and is open to the back side and the front side.

2. The magazine release of claim 1, wherein the spring channel is between the spring retainer slot and the first actuation end.

3. The magazine release of claim 1, wherein the first depth and the second depth are less than half a distance between the bottom and the top of said magazine release.

4. The magazine release of claim 1, wherein the spring retainer slot is open to the back side and bottom of the magazine release and closed to the front side of the magazine release.

5. The magazine release of claim 1, wherein the spring channel is substantially perpendicular to the front side of the magazine release.

6. The magazine release of claim 1, wherein the spring channel extends between a first end wall adjacent said spring retainer slot and a second end wall spaced from said first end wall in a direction toward said first actuation end, wherein said first and second end walls are angled relative to the front side of the magazine release.

7. The magazine release of claim 1, wherein the spring retainer slot is closer to the second flared retainer end than the first actuation end and the spring channel is between the spring retainer slot and the first actuation end.

8. A magazine release comprising:

an elongated one-piece body having a first actuation end and a second flared retainer end, said body having a top side and an opposed bottom side connected by front and back sides;

a spring retainer slot at the bottom side of the magazine release, spaced between the first actuation end and the flared second retainer end of the magazine release, said spring retainer slot having a first depth from the bottom side less than half a distance between the bottom side and the top side of the magazine release; and a spring channel at the bottom side of the magazine release, wherein the spring channel is between the spring retainer slot and the first actuation end of the magazine release, and wherein the first spring channel is spaced from the top side of the magazine release, said first spring channel having a second depth substantially equal to said first depth, wherein the spring retainer slot is open to the back side and not open to the front side of the magazine release, and wherein the first spring channel is open to both the back side and the front side of the magazine release.

9. The magazine release of claim 8, wherein the spring channel is a recess in said bottom side extending along a length of the magazine release between first and second end walls, said first and second end walls spanning the magazine release from said back side to said front side.

10. The magazine release of claim 8, further comprising a second spring retainer slot at the top side of the magazine release, said second spring retainer slot being a mirror image of the spring retainer slot and located at a position along a length of the magazine release aligned with the spring retainer slot, and a second spring channel at the top side of the magazine release, said second spring channel located at a position along the length of the magazine release aligned with the spring channel, and wherein the second spring channel is spaced from the bottom side of the magazine release; wherein the second spring retainer slot is open to the back side of the magazine release and closed to the front side of the magazine release, and wherein the second spring channel is open to both the back and front sides of the magazine release.

11. The magazine release of claim 8, wherein the spring retainer slot is closer to the second flared retainer end than the first actuation end.

12. The magazine release of claim 8, wherein the spring channel is substantially perpendicular to the front side of the magazine release.

13. The magazine release of claim 9, wherein the first and second end walls of the spring channel are angled relative to the front side of the magazine release and parallel to each other.

14. The magazine release of claim 10, wherein the top and bottom sides of the magazine release are mirror images of each other.

15. The magazine release of claim 10, wherein the second spring channel is substantially perpendicular to the front side of the magazine release.

16. The magazine release of claim 10, wherein the second spring channel is angled relative to the front side of the magazine release.

17. A magazine release comprising:

an elongated one-piece body having a first actuation end and a second flared retainer end, said body having a top side and an opposed bottom side connected by front and back sides;

a first spring retainer slot at the bottom side of the magazine release between the first actuation end and the second flared retainer end, said first retainer slot extending from said back side a first distance towards said front side and having a first depth from the bottom side;

a first spring channel at the bottom side, between said first retainer slot and said first actuation end, said first spring channel extending from said back side to said front side, and said first spring channel having a second depth from the bottom side, said second depth substantially equal to said first depth;

a second spring retainer slot at the top side of the magazine release between said first actuation end and said second flared retainer end, said second retainer slot extending from said back side a second distance towards said front side and having a third depth from the top side, and said third depth substantially equal to said first depth; and a second spring channel at the top side, between said second retainer slot and said first actuation end, said second spring channel extending from said front side to said back side, and said second spring channel has a fourth depth from the top side, said fourth depth being substantially equal to said first depth;

wherein the first and third depths do not exceed a distance between said bottom and top sides of the magazine release and the second and fourth depths do not exceed the distance between said bottom and top sides of the magazine release;

wherein the first and second spring retainer slots are open to the back side and closed to the front side and the first and second spring channels are open to both the front and back sides of the magazine release.

18. The magazine release of claim 17, wherein the top side and bottom sides of the magazine release are mirror images of each other.

* * * * *